US012029287B2

(12) United States Patent
Ye et al.

(10) Patent No.: US 12,029,287 B2
(45) Date of Patent: Jul. 9, 2024

(54) MANUFACTURING METHOD OF WRISTBAND EMBEDDED WITH MULTIPLE GROUPS OF ELECTRODE PIECES

(71) Applicants: Fasikl Incorporated, Dallas, TX (US); Hangzhou Fasikl Technology Co., Ltd, Hangzhou (CN)

(72) Inventors: Bing Ye, Hangzhou (CN); Baitong Wang, Hangzhou (CN); Edward Keefer, Dallas, TX (US)

(73) Assignees: Fasikl Incorporated, Dallas, TX (US); Hangzhou Fasikl Technology Co., Ltd, Hangzhou (CN)

( * ) Notice: Subject to any disclaimer, the term of this patent is extended or adjusted under 35 U.S.C. 154(b) by 0 days.

(21) Appl. No.: 18/118,134

(22) Filed: Mar. 7, 2023

(65) Prior Publication Data

US 2023/0200503 A1 Jun. 29, 2023

(51) Int. Cl.
*B29C 45/14* (2006.01)
*A44C 27/00* (2006.01)

(52) U.S. Cl.
CPC ..... *A44C 27/00* (2013.01)

(58) Field of Classification Search
CPC ..... H04M 2250/12; G06F 1/163; A44C 5/0053; A44C 5/0007; A44C 5/0015; A61B 5/256; A61B 5/00
See application file for complete search history.

(56) References Cited

U.S. PATENT DOCUMENTS

| | | | |
|---|---|---|---|
| 2009/0049722 A1 | 2/2009 | Chan | |
| 2012/0186121 A1 | 7/2012 | Hanssen et al. | |
| 2013/0262298 A1 | 10/2013 | Morley | |
| 2023/0004129 A1* | 1/2023 | Ershov | G04B 47/063 |

* cited by examiner

*Primary Examiner* — Jun S Yoo
(74) *Attorney, Agent, or Firm* — Zhigang Ma

(57) ABSTRACT

The present disclosure discloses a manufacturing method of a wristband embedded with multiple groups of electrode pieces. The present disclosure provides a band manufacturing method that can take metal electrodes and silica gel electrodes into account, which ensures that the electrodes are firm and will not fall off when the wristband is worn. All the electrodes are clung to the skin through electrode bands, so that the wires are effectively prevented from being intertwined and broken, and the service life of the wires can be prolonged. Meanwhile, fast mounting and connection between the electrodes and the main unit are realized, and it can also be ensured that joints of the band and the main unit after assembling are waterproof.

8 Claims, 7 Drawing Sheets

MANUFACTURING METHOD OF WRISTBAND EMBEDDED WITH MULTIPLE GROUPS OF ELECTRODE PIECES

TECHNICAL FIELD

The present disclosure relates to the technical field of medical apparatuses, specifically to a manufacturing method of a wristband embedded with multiple groups of electrode pieces.

BACKGROUND

Biomedical electrodes are generally divided into detection electrodes and electrical stimulation electrodes. Due to the physical and chemical changes in an organism, positive and negative charges of various parts of the organism are distributed non-uniformly, resulting in unequal potentials in different parts of the organism or inside and outside cells. To measure the potentials of different parts, an electrode needs to be used to guide the potential of this part to a potential measuring instrument for measurement. This electrode is referred to as a detection electrode. A detection electrode is a sensitive element, which is used for measuring a biological potential, such as an ECG electrode.

A stimulation electrode is an electrode used for applying a current or voltage to an organism. A stimulation electrode is an executive element, which is mainly used in three aspects: 1. Studying the rules of conduction and response of excitable tissues. 2. Introducing an external current into an organism so as to achieve the purpose of curing certain diseases. 3. Controlling or replacing some functions of an organism, such as an electrode used for treating neuralgia in clinic.

In existing wearable medical devices, especially wrist-worn devices, electrode pieces are generally embedded in a bottom surface of a main unit. Generally, only one to two electrode pieces can be arranged at the bottom of the main unit. For devices that need to be provided with multiple electrode pieces, it is usually externally connected with multiple electrode pieces through wires. Embedding the electrode pieces in the bottom of the main unit restrains the use space of the main unit, which is not conducive to the layout of parts in the main unit. If the electrodes are connected outside through the wires, the operation is time-consuming and inconvenient. The electrodes need to be sorted out after use, which brings users a bad experience.

An electrode piece is generally used as a consumable and needs to be replaced regularly. For a wrist-worn medical device that requires multiple electrode pieces to work together, the electrode pieces can be manufactured by a mature technology and integrated into a whole, and can be quickly mounted on and removed from the main unit. This becomes an urgent problem to be solved for the wrist-worn medical device.

SUMMARY

The present disclosure aims to provide a manufacturing method of a wristband embedded with multiple groups of electrode pieces, which solves the problems in the above background section.

In order to achieve the above objective, the present disclosure provides the following technical solution: A manufacturing method of a wristband embedded with multiple groups of electrode pieces. The wristband includes electrode pieces, a band main body, a flexible printed circuit (FPC) assembly and a sealing belt. The manufacturing method includes:

S1: electrode pieces are selected from metal electrode pieces or silica gel electrode pieces;

S2: the multiple electrode pieces are placed in a corresponding die cavity; liquid silica gel is injected into the die cavity, and the band main body is formed after the liquid silica gel is cooled; circumferential sides of the multiple electrode pieces are all wrapped and fixed by the band main body, and binding surfaces of the multiple electrode pieces slightly protrude from an inner side surface of the band main body;

S3: the FPC assembly includes an FPC flexible flat cable and an upper cover plate; a start end of the FPC flexible flat cable is matched with the upper cover plate; the upper cover plate is covered on the FPC flexible flat cable; one boss is arranged on each of two sides of an upper surface of the upper cover plate; the two bosses are both provided with a plurality of mounting holes; a plugboard type pin is arranged in each mounting hole; the plugboard type pins penetrate through the upper cover plate; plugging holes matched with the plugboard type pins are formed in the start end of the FPC flexible flat cable; tail ends of the plugboard type pins are respectively plugged into the multiple plugging holes and are welded and fixed; bonding pads corresponding to the number of the electrode pieces are arranged on an inner side surface of the FPC flexible flat cable; a conduction pin is welded on each bonding pad;

S4: two hole locations matched with the conduction pins are reserved on a back side of each electrode piece; the multiple conduction pins are embedded into the multiple hole locations in a one-to-one correspondence manner; the FPC assembly naturally bends and fits to an outer side surface of the band main body;

S5: the band main body, the electrode pieces and the FPC assembly which are connected into a whole are placed in another corresponding die cavity; liquid silica gel is injected for the second time; the sealing belt is formed after the liquid silica gel injected for the second time is cooled; the sealing belt and the band main body wrap the FPC assembly; two openings matched with the bosses are reserved on the sealing belt; the two bosses pass through the two openings in a one-to-one correspondence manner; and the binding surfaces of the multiple electrode pieces slightly protrude from the inner side surface of the band main body, thus completing the manufacturing of the wristband.

In the present disclosure, a chip accommodating slot is reserved in the upper cover plate; an identification (ID) chip is embedded in the chip accommodating slot; and the ID chip is electrically connected with the FPC flexible flat cable.

In the present disclosure, each boss is provided with two magnet mounting holes; the two magnet mounting holes are respectively located on two sides of the plugboard type pins; magnets are embedded into bottoms of the magnet mounting holes after adhesives are adhered to the bottoms; and upper surfaces of the magnets are flush with an upper surface of the sealing belt.

In the present disclosure, the electrode piece is a metal electrode piece; the metal electrode piece includes a conductive metal sheet and an adhesive coating layer; a plurality of small holes are arranged on a circumferential side of the conductive metal sheet; liquid glue is injected after the conductive metal sheet is placed in a special die cavity; the liquid glue can flow into the small holes; after the liquid glue is cooled, the conductive metal sheet can be stably connected with the adhesive coating layer; hole locations matched with the conduction pins are reserved on the adhesive coating layer; and the conduction pins are connected with the conductive metal sheet in an elastic resisting manner after being fastened into the hole locations of the adhesive coating layer.

In the present disclosure, the electrode piece is a silica gel electrode piece; hot-molten silica gel mixed with electroplating graphite is injected into the special die cavity; after the hot-molten silica gel is cooled, the silica gel electrode piece is formed; hole locations matched with the conduction pins are reserved on the silica gel electrode piece; a diameter of each hole location is slightly less than that of the conduction pin; and the conduction pins are in interference fit and fixed after being fastened into the hole locations of the silica gel electrode piece.

In the present disclosure, the binding surfaces of the electrode pieces can be curved surfaces or planes. The binding surfaces can be set according to the human engineering. The curvature of each binding surface is set according to a portion in contact with a user.

In the present disclosure, a circle of protrusion portion is arranged on the upper surface of the sealing belt; the protrusion portion is annularly closed; and the protrusion portion surrounds the two bosses.

In the present disclosure, the plugboard type pins and the conduction pins for the metal electrode pieces are pogopins.

In the present disclosure, the conduction pins for the silica gel electrode pieces are non-pogopins.

Compared with the prior art, the present disclosure has the following beneficial effects.

1. In the present disclosure, by means of placing the electrode pieces in the corresponding die cavity, injecting the liquid silica gel into the die cavity, and forming the band main body after the liquid silica gel is cooled, so that the electrode pieces and the band main body achieve a close connection effect. After the FPC assembly is mounted and fixed on the outer side surface of the band main body, the FPC assembly is then placed in another corresponding die cavity, and the liquid silica gel is injected for the second time to form the sealing belt. The sealing belt and the band main body are connected into a whole and wrap the FPC assembly. The bosses and the plugboard type pins and magnets on the bosses are located on the upper surface of the sealing belt. The circumferential sides of the two bosses are closely connected with the sealing belt. By means of secondary injection molding, the FPC assembly and the electrode pieces achieve a better encapsulation effect.

2. In the present disclosure, when the metal electrode pieces are used, one adhesive coating layer is wrapped outside the conductive metal sheets, so that the problem of poor adhesion between the metal sheets and the liquid silica gel during injection is solved. Therefore, the electrode pieces and the band main body are connected more firmly, and the service life is prolonged.

3. In the present disclosure, by means of elastic resisting connection between the conduction pins and the conductive metal sheets, welding can be reduced, and stable electrical conduction can be achieved.

4. In the present disclosure, by means of interference fit wrapping connection between the conduction pins and the conductive silica gel sheets, welding can be reduced, and stable electrical conduction can be achieved.

5. In the present disclosure, the protrusion portion is provided. Since an annular trench is arranged at a bottom of the fixed main unit cooperatively used with the wristband, the protrusion portion is embedded into the annular trench, which can effectively enhance the waterproof effect after the wristband is assembled with the fixed main unit.

DETAILED DESCRIPTION OF THE EMBODIMENTS

The technical solutions in the embodiments of the present disclosure will be described clearly and completely below in combination with the accompanying drawings of the embodiments of the present disclosure. Apparently, the described embodiments are only part of the embodiments of the present disclosure, not all embodiments. All other embodiments obtained by those of ordinary skill in the art based on the embodiments in the present disclosure without creative work shall fall within the protection scope of the present disclosure.

Figure 1:
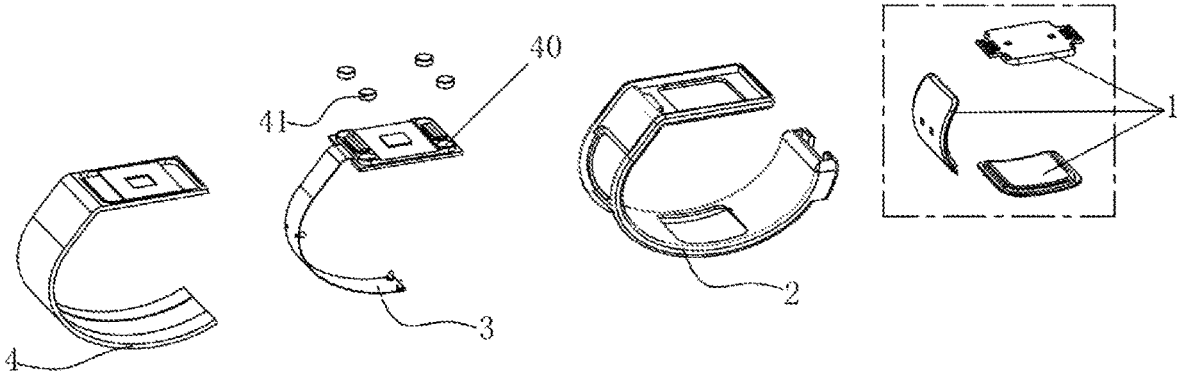
FIG. 1 is a schematic exploded structural diagram of the present disclosure.
Figure 2:
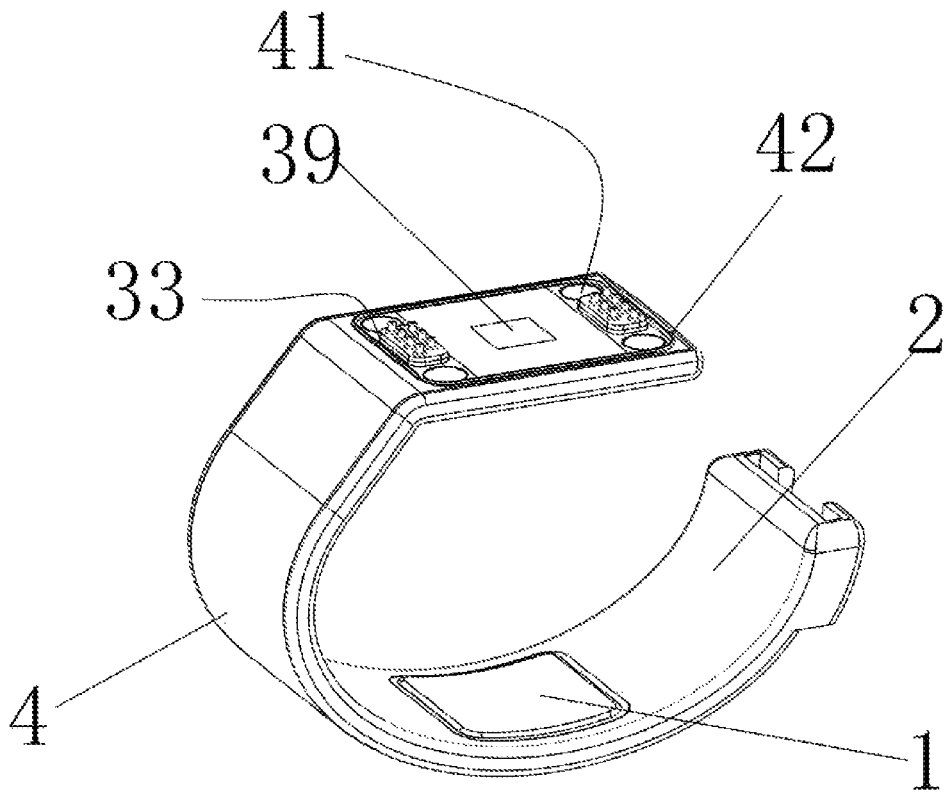
FIG. 2 is a schematic structural diagram of the present disclosure.
Figure 3:
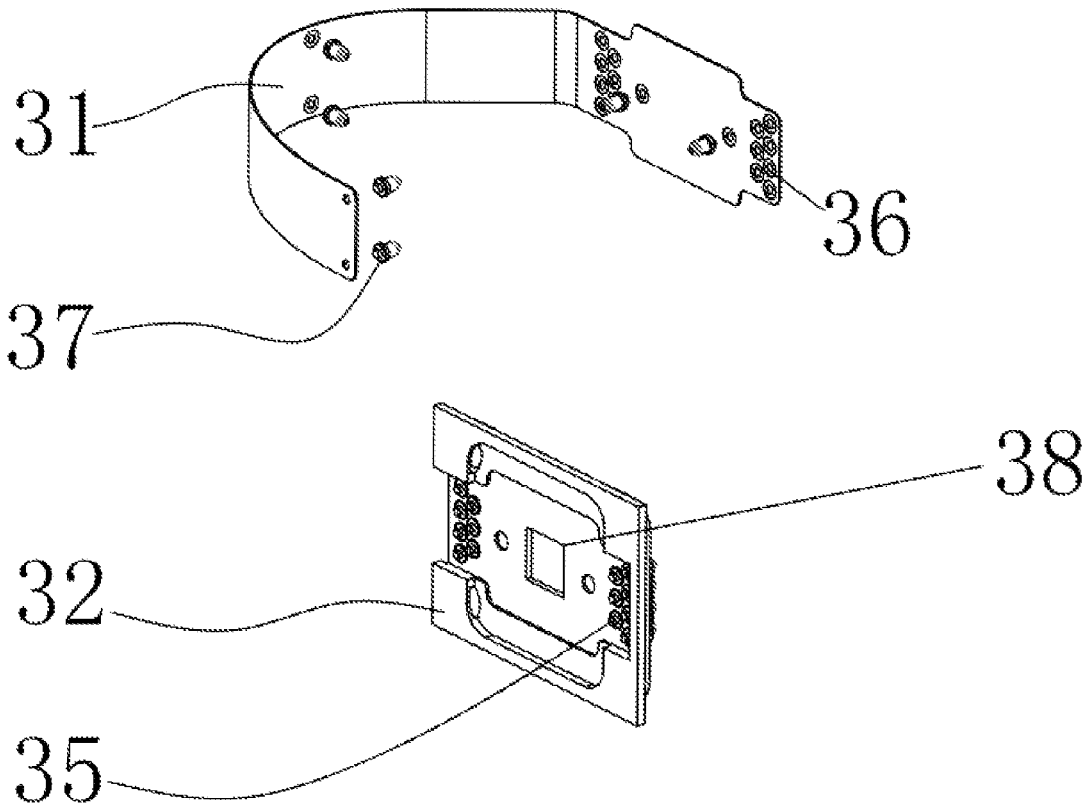
FIG. 3 is a schematic exploded structural diagram of an FPC assembly of the present disclosure.
Figure 4:
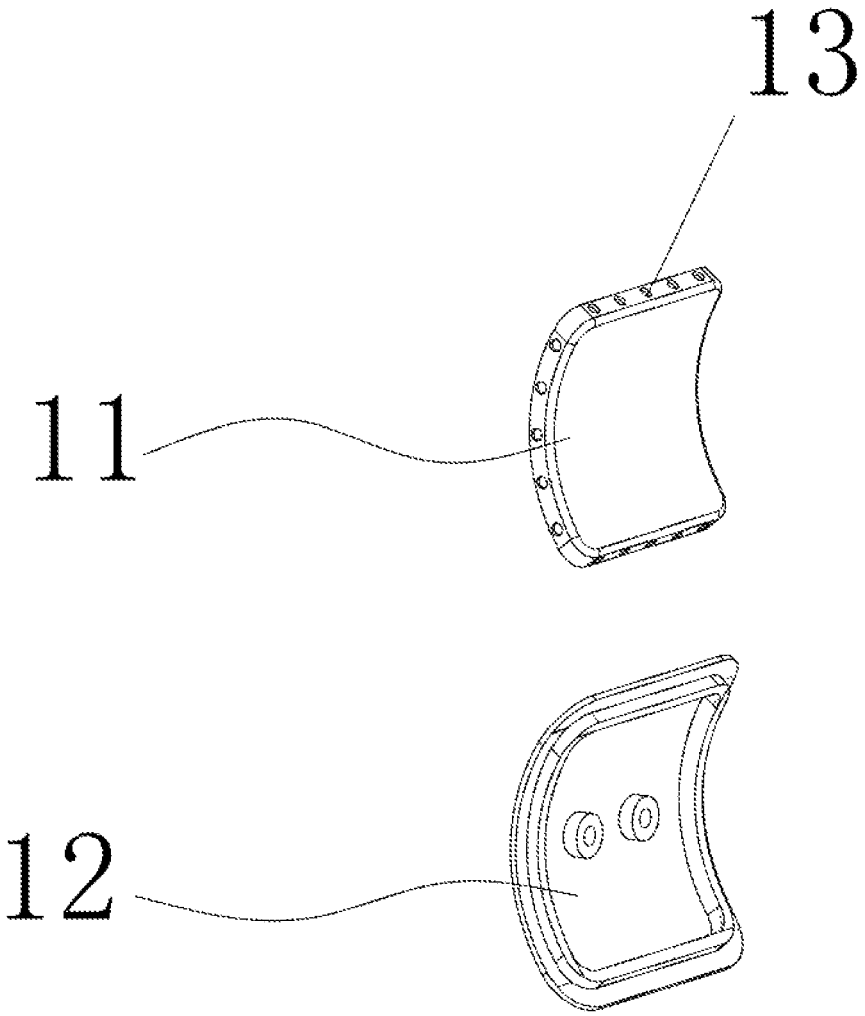
FIG. 4 is a schematic exploded structural diagram of a metal electrode piece of the present disclosure.
Figure 5:
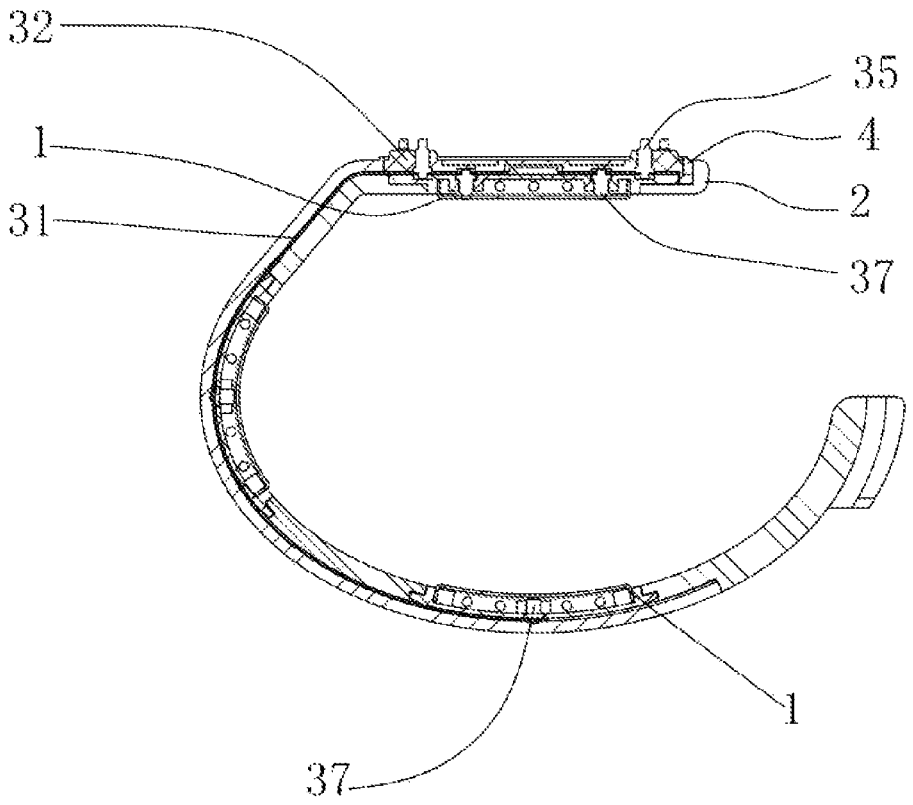
FIG. 5 is a sectional view of the present disclosure.
Figure 6:
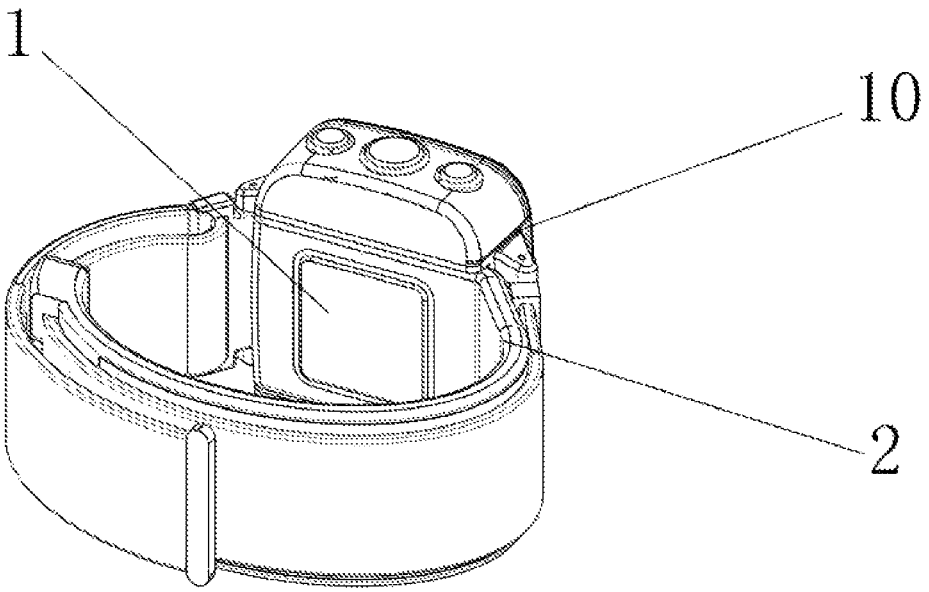
FIG. 6 is an assembling diagram of a fixed main unit and a wristband of the present disclosure.
Figure 7:
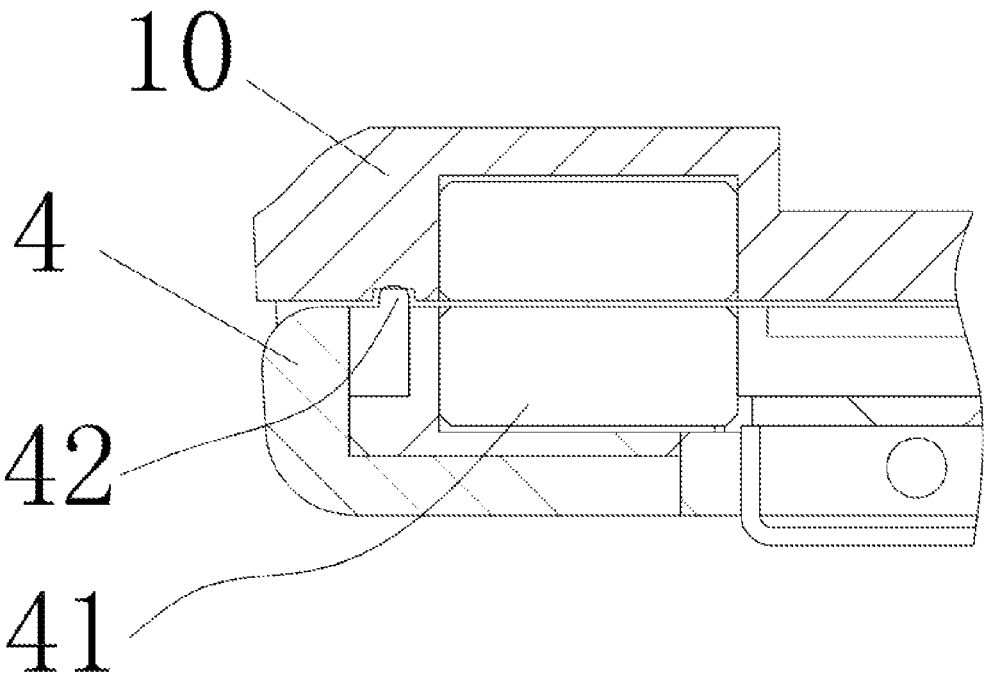
FIG. 7 is a partially cutaway view in FIG. 6.

Referring to FIG. 1 to FIG. 5, one embodiment provided by the present disclosure is shown. A manufacturing method of a wristband embedded with multiple groups of electrode pieces includes:

S1: electrode pieces 1 are selected from metal electrode pieces or silica gel electrode pieces;

S2: the multiple electrode pieces 1 are placed in a corresponding die cavity; liquid silica gel is injected into the die cavity, and the band main body 2 is formed after the liquid silica gel is cooled; and circumferential sides of the multiple electrode pieces 1 are all wrapped and fixed by the band main body 2, and binding surfaces of the multiple electrode pieces 1 slightly protrude from an inner side surface of the band main body 2, so that the multiple electrode pieces 1 and the band main body 2 are connected into a whole to prevent clearances in connection portions of the electrode pieces 1 and the band main body 2 and enhance the encapsulation effect.

S3: the FPC assembly 3 includes an FPC flexible flat cable 31 and an upper cover plate 32; a start end of the FPC flexible flat cable 31 is matched with the upper cover plate 32; the upper cover plate 32 is covered on the FPC flexible flat cable 31; two bosses 33 are arranged on the upper cover plate 32; the two bosses 33 are both provided with a plurality of mounting holes. In this embodiment, each boss 33 is provided with seven mounting holes. A plugboard type pin 35 is arranged in each mounting hole. The plugboard type pins 35 penetrate through the upper cover plate 32. Plugging holes 36 matched with the plugboard type pins 35 are formed in the start end of the FPC flexible flat cable 31. Tail ends of the plugboard type pins 35 are respectively plugged into the multiple plugging holes 36 and are welded and fixed, so that the FPC flexible flat cable 31 is fixedly connected with the upper cover plate 32. Bonding pads corresponding to the number of the electrode pieces 1 are arranged on an inner side surface of the FPC flexible flat cable 31. Two conduction pins 37 are welded on each bonding pad.

S4: two hole locations matched with the conduction pins 37 are reserved on a rear end surface of each electrode piece 1. The multiple conduction pins 37 are embedded into the multiple hole locations. The FPC flexible flat cable 31 fits to an outer side surface of the band main body 2.

S5: the band main body 2, the electrode pieces 1 and the FPC assembly 3 which are connected into a whole are placed in another corresponding die cavity. Liquid silica gel is injected for the second time. The sealing belt 4 is formed after the liquid silica gel injected for the second time is cooled. The sealing belt 4 and the band main body 2 wrap the FPC assembly 3. Two openings matched with the bosses 33 are reserved on the sealing belt 4. The two bosses 33 pass through the two openings to keep the plugboard type pins 35 on an upper surface of the sealing belt 4, which is convenient for being connected and used with the fixed main unit 10, preventing clearances in connection portions of the bosses 33 and the sealing belt 4 and enhancing the encapsulation effect. The binding surfaces of the multiple electrode pieces 1 slightly protrude from the inner side surface of the band main body 2, thus completing the manufacturing of the wristband.

A molding temperature of the above liquid silica gel is below 120 DEG C., and a heat-resistance temperature of the FPC assembly 3 is greater than 200 DEG C. The molding temperature of the liquid silica gel is much lower than the heat-resistance temperature of the FPC assembly 3. When the liquid silica gel is injected for the second time, the temperature of the liquid silica gel is not enough to dissolve the FPC assembly 3, which ensures the normal use of the wristband after assembling.

In the present disclosure, a chip accommodating slot 38 is reserved in the upper cover plate 33. An ID chip 39 is embedded in the chip accommodating slot 38. The ID chip 39 is electrically connected with the FPC flexible flat cable 31. When the fixed main unit 10 is electrically connected with the wristband, the fixed main unit 10 can detect and identify the independent ID number in the ID chip 39 to acquire parameters such as conduction information, ensuring that the wristband used by a user adapts to the fixed main unit 10.

In the present disclosure, each boss 33 is provided with two magnet mounting holes 40. The two magnet mounting holes 40 are respectively located on two sides of the plugboard type pins 35. Magnets 41 are embedded into bottoms of the magnet mounting holes 40 after adhesives are adhered to the bottoms. Upper surfaces of the magnets 41 are flush with an upper surface of the sealing belt 4. Second magnets matched with the multiple magnets 41 and a plurality of connecting holes matched with the plugboard type pins 35 are also arranged at the bottom of the fixed main unit 10. The plugboard type pins 35 are plugged into the connecting holes, and quick assembling and disassembling of the wristband and the fixed main unit are realized by means of attractive connection between the magnets 41 and the second magnets. Furthermore, the wristband and the fixed main unit are electrically connected through the connecting holes and the plugboard type pins 35, thus indirectly realizing the electrical connection between the fixed main unit 10 and the electrode pieces 1.

Further, the plugboard type pins 35 are pogopins, each of which is a spring type probe formed by pre-riveting three basic components, i.e. a pin shaft, a spring and a pin tube through a precision instrument. One precision spring structure is provided inside the pogopin. When the pogopins are plugged into the connecting holes, their elasticity can ensure that the pluboard type pins 35 are connected to pin contact points in the connecting holes in an elastic resisting manner, so that power-off connection between the fixed main unit 10 and the wristband is prevented, which improves the stability of an electrotherapy.

Further, a circle of protrusion portion 42 is arranged on the upper surface of the sealing belt 4. The protrusion portion 42 is molded by injecting the liquid silica gel for the second time. The protrusion portion 42 is annularly closed. The protrusion portion 42 of this embodiment is rectangular, and the slight protrusion portion 42 encloses the two bosses. An annular trench is arranged at a bottom of the fixed main unit 10. The annular trench surrounds the connecting holes and the second magnets. The annular trench is matched with the shape and size of the protrusion portion 42. The protrusion portion 42 is embedded into the annular trench. The protrusion portion 42 is in close fit with the annular trench to achieve waterproofing between the fixed main unit 10 and the wristband, which can effectively enhance the waterproof effect after the wristband and the fixed main unit 10 are assembled.

In the present disclosure, when the electrode piece 1 is a metal electrode piece, the metal electrode piece includes a conductive metal sheet 11 and an adhesive coating layer 12. A plurality of small holes 13 are arranged on a circumferential side of the conductive metal sheet 11. Liquid plastic is injected after the conductive metal sheet 11 is placed in a special die cavity. The liquid plastic can flow into the small holes 13. After the liquid plastic is cooled, the conductive metal sheet 11 can be stably connected with the adhesive coating layer 12. The conductive metal sheet 11 and the adhesive coating layer 12 are completely fitted. Hole locations matched with the conduction pins 37 are reserved on the adhesive coating layer 12. The conduction pins 37 the plugboard type pins 35 with elastic contacts. Tail portions of the conduction pins 37 are welded and fixed in the FPC flexible flat cable 31. The conduction pins 37 are connected with inner side surface of the conductive metal sheet 11 in an elastic resisting manner after being fastened into the hole locations of the adhesive coating layer 12. The electrical connection between the FPC flexible flat cable 31 and the electrode piece 1 is ensured by means of durable contact with the elastic contacts. A material of the conductive metal sheet 11 of this embodiment is copper, and one layer of gold or silver chloride is electroplated on the binding surface of the conductive metal sheet 11. Plating gold or silver can improve the conduction performance, the abrasion resistance and the corrosion resistance. The conductive metal sheet can contact the skin for a long time, and the parameter performance and the service life can be improved.

In the present disclosure, when the electrode piece 1 is a silica gel electrode piece, hot-molten silica gel mixed with electroplating graphite is injected into the special die cavity. After the hot-molten silica gel is cooled, the silica gel electrode piece is formed. Hole locations matched with the conduction pins 37 are reserved on the silica gel electrode piece, and a diameter of each hole location is slightly less than that of the conduction pin 37. The conduction pins 37 are in interference fit and fixed after being fastened into the hole locations of the silica gel electrode piece, thus realizing connection between the FPC flexible flat cable 31 and the electrode piece 1. The conduction pins 37 for the silica gel electrode piece are non-pogopins which are pins without spring structures inside. The resistance of the silica gel electrode piece of this embodiment is less than 5 Ω, which can effectively ensure good electrical conduction between the conduction pins 37 and the silica gel electrode piece and achieve a better electrotherapy effect. In addition, a molding temperature of the silica gel electrode piece is greater than that of the liquid silica gel, which can prevent the silica gel electrode piece from being dissolved during injection molding of the liquid silica gel.

The binding surfaces of the electrode pieces 1 can be curved surfaces or planes. The binding surfaces can be set according to the human engineering. The curvature of each binding surface is set according to a portion in contact with a user. Totally three electrode pieces 1 are uniformly arranged on the FPC flexible flat cable 31 of this embodiment. The binding surface of the electrode piece 1 located below the upper cover plate 32 is a plane, and the binding surfaces of the other two electrode pieces 1 are curved surfaces. Furthermore, the curvatures of the two electrode pieces 1 with the curved surfaces are set according to the portion contacting a user, so that the electrode pieces 1 can be perfectly fitted to the skin of the user, and cooperate with an electro-therapeutic apparatus for electrotherapy to achieve the best electrotherapy effect.

The binding surfaces of the electrode pieces 1 are used for contacting the skin of the user, and the fixed main unit 10 outputs a corresponding stimulation current to the electrode pieces 1 to achieve the electrotherapy effect.

For those skilled in the art, it is apparent that the present disclosure is not limited to the details of the demonstrative embodiments mentioned above, and that the present disclosure can be realized in other specific forms without departing from the spirit or basic features of the present disclosure. Therefore, from any point of view, the embodiments should be regarded as exemplary and non-limiting. The scope of the present disclosure is defined by the appended claims rather than the above description. Therefore, all changes falling within the meanings and scope of equivalent elements of the claims are intended to be included in the present disclosure. No drawing markings in claims shall be deemed to limit the claims involved.

What is claimed is:

1. A manufacturing method of a wristband embedded with multiple groups of electrode pieces, wherein the wristband comprises electrode pieces, a band main body, a flexible printed circuit (FPC) assembly and a sealing belt;

S1: the electrode pieces are selected from metal electrode pieces or silica gel electrode pieces;

S2: the multiple electrode pieces are placed in a corresponding die cavity; liquid silica gel is injected into the die cavity, and the band main body is formed after the liquid silica gel is cooled; circumferential sides of the multiple electrode pieces are all wrapped and fixed by the band main body, and binding surfaces of the multiple electrode pieces slightly protrude from an inner side surface of the band main body;

S3: the FPC assembly includes an FPC flexible flat cable and an upper cover plate; a start end of the FPC flexible flat cable is matched with the upper cover plate; the upper cover plate is covered on the FPC flexible flat cable; one boss is arranged on each of two sides of an upper surface of the upper cover plate; the two bosses are both provided with a plurality of mounting holes; a plugboard type pin is arranged in each mounting hole; the plugboard type pins penetrate through the upper cover plate; plugging holes matched with the plugboard type pins are formed in the start end of the FPC flexible flat cable; tail ends of the plugboard type pins are respectively plugged into the multiple plugging holes and are welded and fixed; bonding pads corresponding to the number of the electrode pieces are arranged on an inner side surface of the FPC flexible flat cable; two conduction pin are welded on each bonding pad;

S4: two hole locations matched with the conduction pins are reserved on a back side of each electrode piece; the multiple conduction pins are embedded into the multiple hole locations in a one-to-one correspondence manner; the FPC assembly naturally bends and fits to an outer side surface of the band main body;

S5: the band main body, the electrode pieces and the FPC assembly which are connected into a whole are placed in another corresponding die cavity; liquid silica gel is injected for the second time; the sealing belt is formed after the liquid silica gel injected for the second time is cooled; the sealing belt and the band main body wrap the FPC assembly; two openings matched with the bosses are reserved on the sealing belt; the two bosses pass through the two openings in a one-to-one correspondence manner; and the binding surfaces of the multiple electrode pieces slightly protrude from the inner side surface of the band main body, thus completing the manufacturing of the wristband.

2. The manufacturing method of the wristband embedded with the multiple groups of electrode pieces according to claim 1, wherein a chip accommodating slot is reserved in the upper cover plate; an identification (ID) chip is embedded in the chip accommodating slot; and the ID chip is electrically connected with the FPC flexible flat cable.

3. The manufacturing method of the wristband embedded with the multiple groups of electrode pieces according to claim 1, wherein each boss is provided with two magnet mounting holes; the two magnet mounting holes are respectively located on two sides of the plugboard type pins; magnets are embedded into bottoms of the magnet mounting holes after adhesives are adhered to the bottoms; and upper surfaces of the magnets are flush with an upper surface of the sealing belt.

4. The manufacturing method of the wristband embedded with the multiple groups of electrode pieces according to claim 1, wherein the electrode piece is a metal electrode piece; the metal electrode piece comprises a conductive metal sheet and an adhesive coating layer; a plurality of small holes are arranged on a circumferential side of the conductive metal sheet; liquid glue is injected after the conductive metal sheet is placed in a special die cavity; the liquid glue can flow into the small holes; after the liquid glue is cooled, the conductive metal sheet is stably connected with the adhesive coating layer; the hole locations matched with the conduction pins are reserved on the adhesive coating layer; and the conduction pins are connected with the conductive metal sheet in an elastic resisting manner after being inserted into the hole locations.

5. The manufacturing method of the wristband embedded with the multiple groups of electrode pieces according to claim 1, wherein the electrode piece is a silica gel electrode piece; hot-molten silica gel mixed with electroplating graphite is injected into a special die cavity; after the hot-molten silica gel is cooled, the silica gel electrode piece is formed; the hole locations matched with the conduction pins are reserved on the silica gel electrode piece; a diameter of each hole location is slightly less than that of the conduction pin; and the conduction pins are in interference fit and fixed after being fastened into the hole locations of the silica gel electrode piece.

6. The manufacturing method of the wristband embedded with the multiple groups of electrode pieces according to claim 1, wherein the binding surfaces of the electrode pieces are curved surfaces or planes; the binding surfaces are set according to the human engineering; and the curvature of each binding surface is set according to a portion in contact with a user.

7. The manufacturing method of the wristband embedded with the multiple groups of electrode pieces according to claim 1, wherein a circle of protrusion portion is arranged on the upper surface of the sealing belt; the protrusion portion is annularly closed; and the protrusion portion surrounds the two bosses.

8. The manufacturing method of the wristband embedded with the multiple groups of electrode pieces according to claim 1, wherein the plugboard type pins and the conduction pins for the metal electrode pieces are pogopins.

* * * * *